US009765600B2

(12) United States Patent
Geir

(10) Patent No.: US 9,765,600 B2
(45) Date of Patent: Sep. 19, 2017

(54) PUNCHER TOOL

(71) Applicant: TCO AS, Indre Arna (NO)

(72) Inventor: Melhus Geir, Indre Arna (NO)

(73) Assignee: TCO AS, Indre Arna (NO)

( * ) Notice: Subject to any disclaimer, the term of this patent is extended or adjusted under 35 U.S.C. 154(b) by 263 days.

(21) Appl. No.: 14/422,052

(22) PCT Filed: Aug. 16, 2013

(86) PCT No.: PCT/IB2013/002083
§ 371 (c)(1),
(2) Date: Feb. 17, 2015

(87) PCT Pub. No.: WO2014/027245
PCT Pub. Date: Feb. 20, 2014

(65) Prior Publication Data

US 2015/0218918 A1 Aug. 6, 2015

(30) Foreign Application Priority Data

Aug. 17, 2012 (NO) ..... 20120921

(51) Int. Cl.
*E21B 43/116* (2006.01)
*E21B 33/13* (2006.01)
(Continued)

(52) U.S. Cl.
CPC ..... *E21B 43/116* (2013.01); *E21B 33/13* (2013.01); *E21B 43/11* (2013.01); *E21B 2034/002* (2013.01)

(58) Field of Classification Search
CPC .... E21B 43/116; E21B 43/11; E21B 43/1185; E21B 43/11852; E21B 33/13; E21B 2034/002
See application file for complete search history.

(56) References Cited

U.S. PATENT DOCUMENTS 4,688,640 A * 8/1987 Pritchard, Jr. ..... E21B 29/12 166/297
4,756,371 A 7/1988 Brieger et al.
(Continued)

FOREIGN PATENT DOCUMENTS

WO WO 2012/105852 A1 8/2012

OTHER PUBLICATIONS

International Search Report issued in PCT Application No. PCT/IB2013/002083, filed Aug. 16, 2013.
(Continued)

*Primary Examiner* — Brad Harcourt
(74) *Attorney, Agent, or Firm* — Knobbe Martens Olson and Bear, LLP

(57) ABSTRACT

A device and a method are for perforating downhole casings. The method includes arranging a device on a drill string, running the device into a bore hole, dropping a ball down through the drill string down to the device for causing a first sequence of pressure rise and relief, causing a firing system to trigger a charge for punching one or more holes through a surrounding casing wall in response to the first sequence of pressure rise and relief, driving the pressure inside of the drill string up to a second level, and causing a rupture disc at the second level to burst so as to establish a fluid communication between the inside and outside of the drill string through the opening in the pipe wall of the pipe section.

14 Claims, 6 Drawing Sheets

Figure 1:
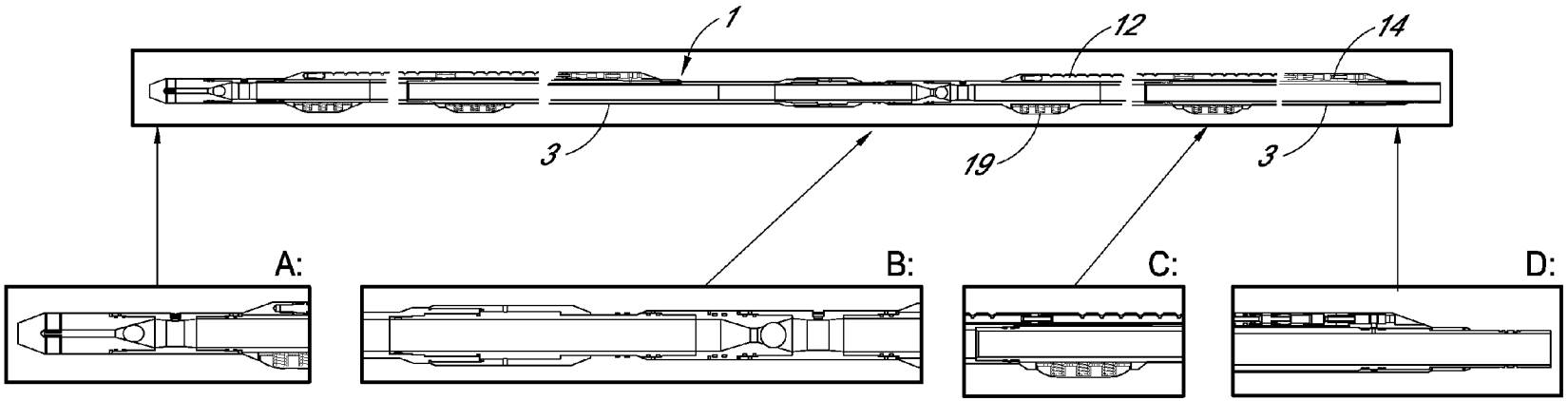

(51) Int. Cl.
*E21B 43/11* (2006.01)
*E21B 34/00* (2006.01)

(56) References Cited

U.S. PATENT DOCUMENTS

| | | | |
|---|---|---|---|
| 5,445,220 | A | 8/1995 | Gurevich et al. |
| 5,890,539 | A | 4/1999 | Huber et al. |
| 7,753,121 | B2 | 7/2010 | Whitsitt et al. |
| 8,151,882 | B2 | 4/2012 | Grigar et al. |
| 2002/0162657 | A1 | 11/2002 | Tumlin et al. |
| 2006/0070730 | A1 | 4/2006 | Grebennikov et al. |
| 2011/0017453 | A1* | 1/2011 | Mytopher ..... E21B 43/11852 166/298 |
| 2012/0111566 | A1 | 5/2012 | Sherman et al. |

OTHER PUBLICATIONS

Search Report dated Feb. 18, 2013 issued in NO Application No. 20120921, filed Aug. 17, 2012.

* cited by examiner

PUNCHER TOOL

CROSS-REFERENCE TO RELATED APPLICATIONS

This application is the U.S. National Phase under 35.U.S.C. §371 of International Application PCT/IB2013/002083, filed Aug. 16, 2013, which claims priority to NO Patent Application No. 20120921, filed Aug. 17, 2012.

The present invention relates to a downhole perforating tool, more specifically a "puncher tool". The present invention also relates to a method for utilizing such a perforating tool.

It is well known in the art to utilize perforating guns to perforate holes through casings, concrete and the surrounding formation, and to thus start a production of hydrocarbons or to increase the exploitation of a hydrocarbon reservoir. Part of the intention with perforating guns is the forming of several holes in the casing and that the perforating length or depth is relatively great, i.e. the holes formed in the formation extend from everything from a few centimeters up to several meters into the surrounding formation.

A puncher tool separates from conventional perforating guns by the desired perforating length or depth being small, generally in an order of magnitude corresponding to the thickness of the casing wall. In addition, several holes are often not required, only a few holes or even one is often sufficient. The intention with puncher guns is generally to make a hole in the nearest casing wall, for investigating and possibly emptying gas pockets and/or squeezing cement, i.e. filling in and sealing off undesirable and unintended voids or channels in the cement surrounding and possibly between casing walls.

Plug and abandon is a critical operation where one must assure oneself that the well is sealed before abandoning it. In addition, the operation is risky because possible gas or oil pockets behind insufficiently cemented casings can result in uncontrolled blowouts. Before cutting the top section of a well, pulling it out and plugging the well, one must first investigate whether there are gas/oil pockets present. This is generally performed by means of thereto suitable logging tools in combination with different logs of cement qualities, variable density, etc.

Next, if the presence of pockets is detected, action must be initiated for possibly ventilating/emptying gas/pressure, and possibly start more drastic action to isolate long channels or big pockets which is not easily ventilated/emptied.

The object of the present invention is to provide a perforating gun which can be run on a drill string, and which can be fired several times during a run, which can be used for ventilating gas, which can be used for squeezing cement, which can be used for zone isolation, and which can be used for sealing leakages.

The abovementioned object is achieved by means of a device according to the attached independent claim 1 and independent method 7. Further advantageous features and embodiments are indicated in the dependent claims.

Figure 2:
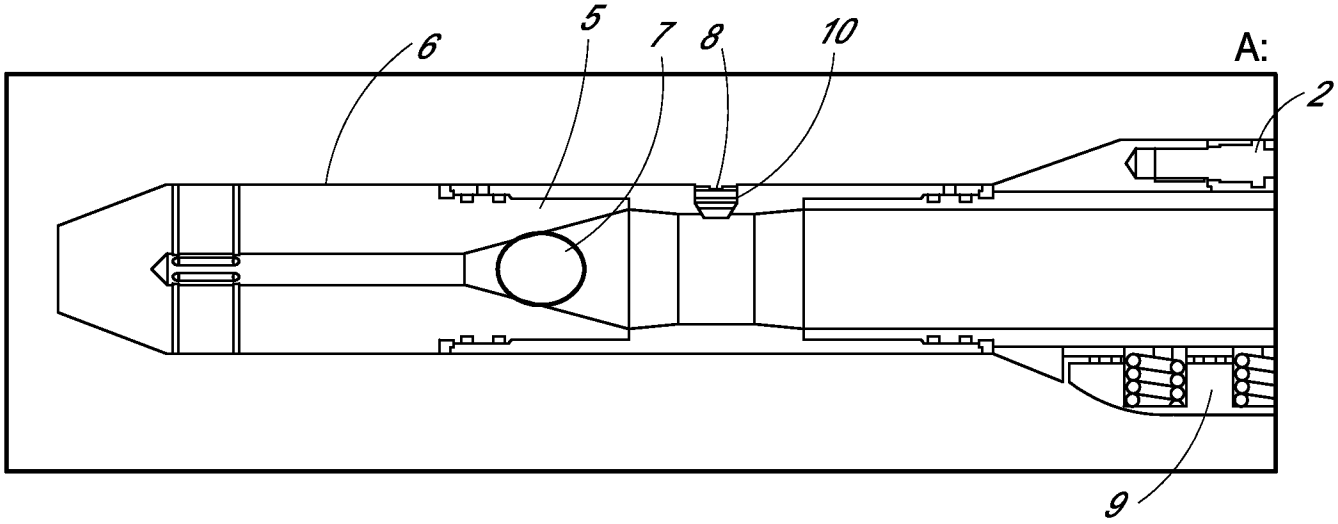
Figure 3:
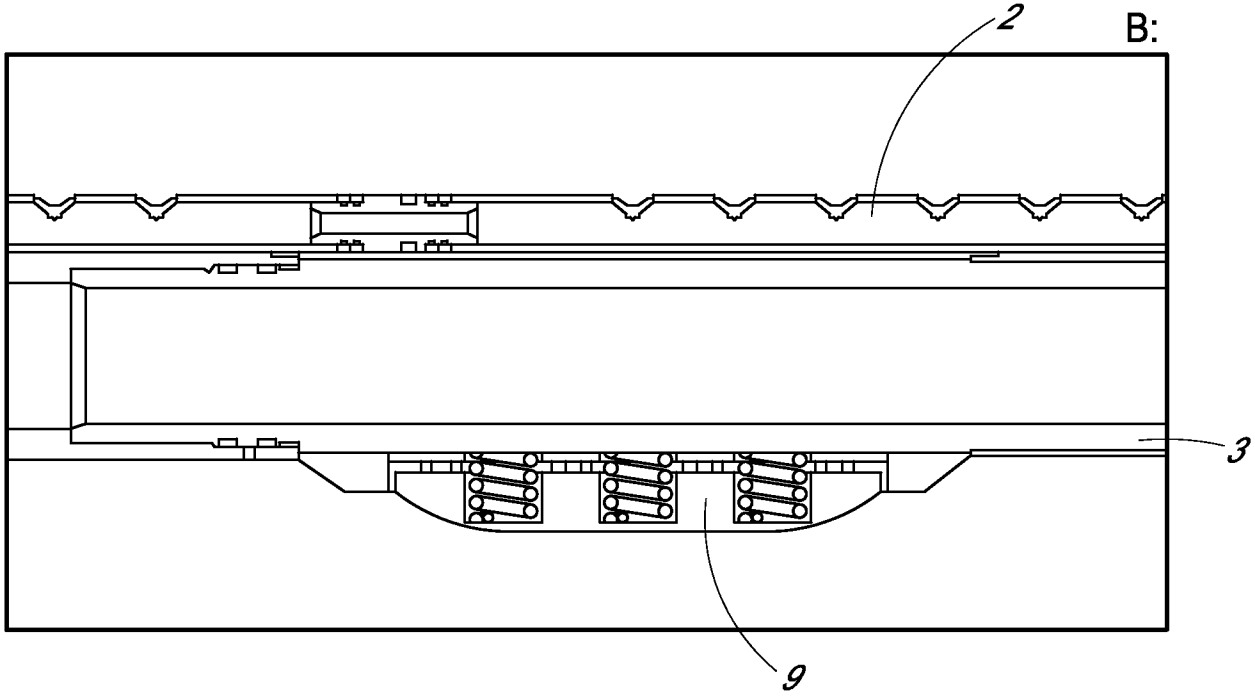
Figure 4:
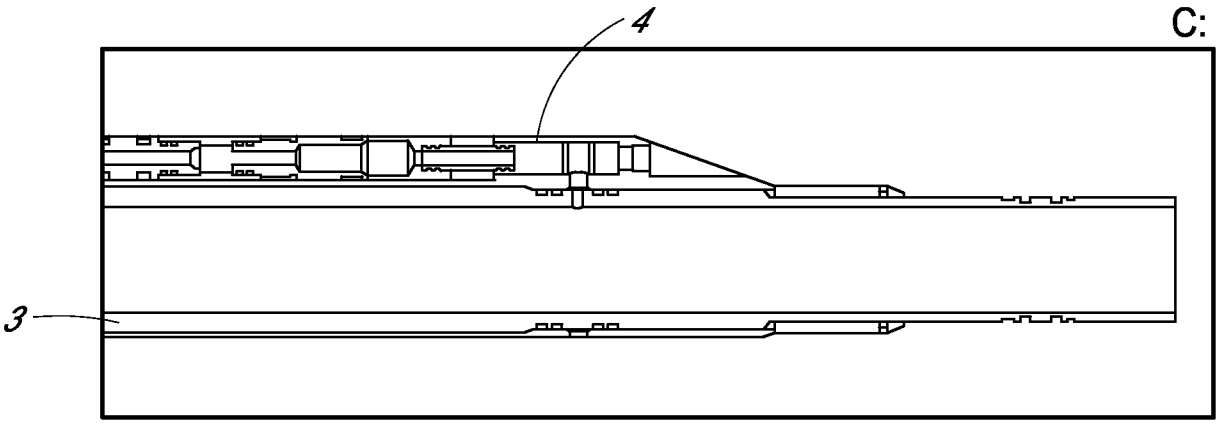
Figure 5:
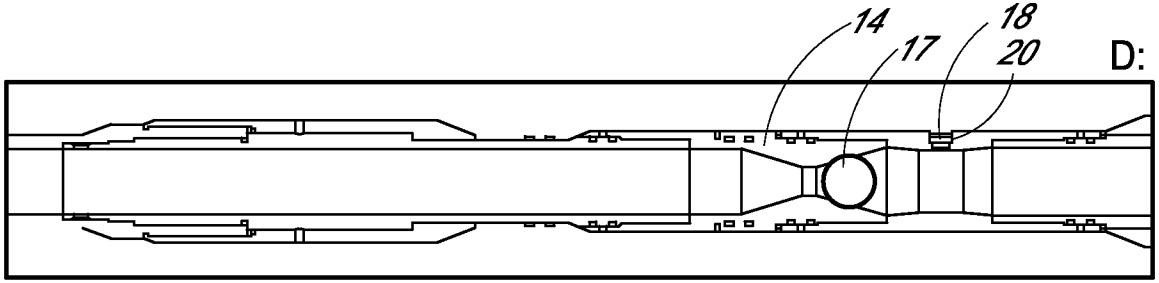
Figure 6:
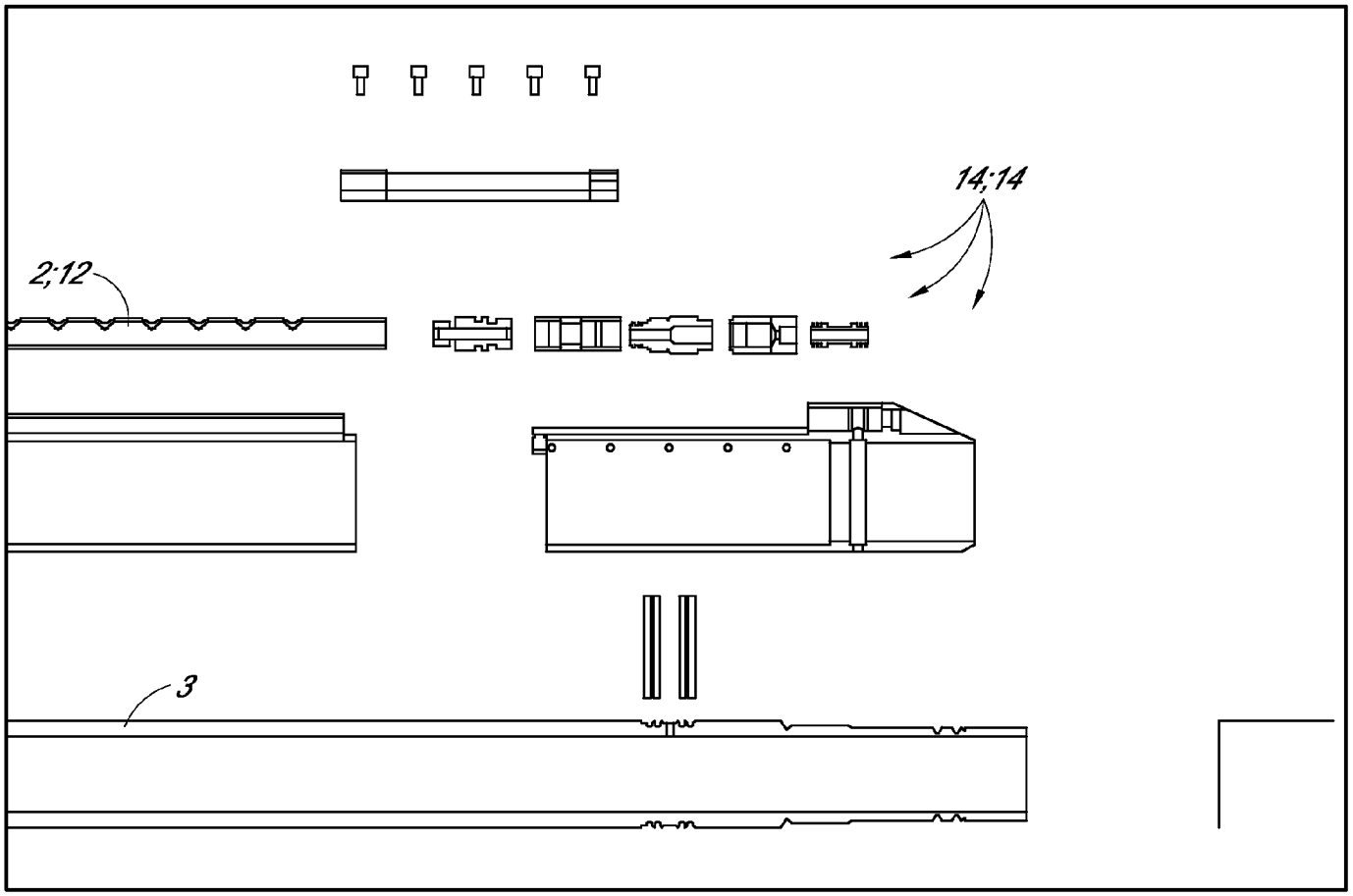

In the following a detailed description of the present invention is given, with reference to the attached figures, where FIG. 1 shows an embodiment of the present invention seen from two different sides, FIG. 2 shows section A from FIG. 1, FIG. 3 shows section B from FIG. 1, FIG. 4 shows section C from FIG. 1, FIG. 5 shows section D from FIG. 1, and FIG. 6 shows an embodiment of a firing system.

FIG. 1 shows a device 1 according to one embodiment of the present invention.

The device 1 according to the present invention comprises preferably charges 2 arranged on the outside, i.e. the charges being fired are arranged on the outside of the pipe section 3 forming the tool 1. The charges 2 are fired by means of firing system 4.

The device according to the shown embodiment is adapted to be run on a drill string, which advantageously makes the tool applicable for circulating or ventilating out possible hydrocarbons or other fluids revealed after the device has punched a hole in the surrounding casing, without need for the device 1 to be tripped out of the well before other, suitable circulation equipment is run down in the well, which would be the case in a conventional run with a perforating gun on a wire line. This aspect, which is preferable but not a necessary aspect of the present invention, will be further described under.

To achieve the desired, predetermined sequence of resp. pressure rises and pressure reliefs mentioned above, the device must be capable of being pressurized from the inside. This assumes no fluid communication with the outside of the drill string/device 1 during the pressure rise and pressure relief sequence. To shut off the fluid communication with the outside of the drill string and also build up the pressure on the inside of the drill string for thereby to start the predetermined sequence of resp. pressure rises and pressure reliefs which triggers the firing system 4 of the device 1, the device 1 can be provided with a ball seat 5 furthest down/outermost in a ported end-sub 6, which is shown in FIG. 2. To trigger the charges 2, a ball 7 is dropped/pumped through the drill string and device 1. The ball 7 has a diameter which makes it settle in the ball seat 5. The ball seat 5 can have an opening of for instance 1.25 inches. The ball 7 settles in the ball seat 5 and shuts the opening formed by the ball seat 5. The communication between the inside of the drill string/device 1 and the outside is now shut off. The pressure on the inside of the drill string/device 1 can now be increased and undergo the desired pressure rise and pressure relief sequence.

Such a predetermined sequence of resp. pressure rises and pressure reliefs renders simultaneously possible also a selective, optional firing of separate charges. As each charge or row of charges has its own detonator, each detonator can be arranged specifically for each counter which is sensitive for each pressure rise and pressure relief sequence, either a mechanical system or possibly a pressure sensitive, electrically firing system. According to one embodiment of the invention the device 1 comprises a firing system 4 utilizing a pressure sensitive counter which releases a biased firing pin, a striking plate or an equivalent trigger mechanism, after a predetermined sequence of resp. pressure rises and pressure reliefs has been gone through, ref. FIG. 4.

It is understood that the firing system may possibly be activated by means of electric signals, acoustic signals, ultrasound signals, telemetry or a timer function.

At the same time as it is desirable for the device 1 to be able to be pressurized on the inside, it is also desirable that the drill string and the tool is able to circulate or flush out possible hydrocarbons or other fluids revealed after the device has punched holes in the surrounding casing. A circulation or ventilation assumes a communication between the inside and outside of the drill string. To achieve this, one can according to one aspect of the present invention arrange a so-called "burst disc", "rupture disc" or rupture disc 8, ref. FIG. 2. The rupture disc 8 can according to one embodiment be adapted such that it breaks around 2500 psi. Alternatively the ball 7 can be shaped such that it can break or rupture at a desired pressure, for example 2500 psi. Utilizing a breakable ball is however considered less safe and reliable than utilizing a rupture disc.

As the rupture disc 8 according to one embodiment ruptures at around 2500 psi, the predetermined sequence of resp. pressure rises and pressure reliefs to trigger the firing system 4 be within a pressure interval below 2500 psi, generally with a good margin, in the cases where the firing of the detonator takes place by means of hydraulically transmitted pressure signals. One can for instance also picture oneself a scenario where firing is done by means of acoustic signals, ultrasound signals, timer functions or other methods known in the art.

If a leakage is revealed behind the surrounding casing and this leakage causes a very large pressure buildup, this can cause the rupture disc 8 to collapse inwardly from the outside. The device according to the present invention can be adapted to such situations.

The device 1 described above renders possible for instance the following operation:

- the device 1 is arranged on the drill string and is run down in the bore hole to the desired depth,
- a ball 7 is dropped down through the drill string and to the device 1, where the ball 7 rests in the ball seat 5. This blocks the fluid communication to the outside of the drill string/device 1, and one is with that able to pump up the pressure in the drill string and carry through a predetermined first sequence of resp. pressure rises and pressure reliefs, such that the firing system 4, arranged to react to said first sequence of resp. pressure rises and pressure reliefs, triggers the charge 2. The triggering of charge 2 punches one or several holes in the casing wall.
- the pressure in the drill string, which until now has been held well below 2500 psi, is now run up to app. 2500 psi. This causes the rupture disc 8 to burst and a fluid communication to arise between the inside of the drill string and the outside.
- a circulation through the well is started to flush out the contents of a possible pocket of hydrocarbons revealed by the charge 2 behind the casing wall. Thereto suitable measuring and detection means can be utilized to detect whether hydrocarbons have been revealed. The circulation/ventilation takes place until the measuring and detection means show that the concentration of hydrocarbons is starting to decline and then falls below acceptable levels. If it is a great leakage, other actions can be taken in order to seal the leakage. These actions can comprise cementing operations, squeezing cement, placing zone isolation seals, placing seals, pumping heavy well fluids and pumping well fluids comprising sealing materials.

According to a preferred embodiment of the present invention, two or more rows of charges are arranged simultaneously on the same drill string, ref. FIG. 1. By arranging a second row of charges 12 above said first row of chargers 2, one will be able to run two separate rows of charges down into the well simultaneously. A second ball seat 15 with a larger opening than the ball seat 15 is arranged somewhere between the first and second row of charges 2, 12. The second ball seat 15 is arranged somewhere above the first rupture disc 8. In connection with the second row of charges 12 and the second ball seat 15, it is arranged a second rupture disc 18 which do not burst until the pressure reaches for example 4000 psi, and also a detonator 14 comprising a trigger mechanism/counter/electric firing system effected by another predetermined sequence of resp. pressure rises and pressure reliefs. According to an embodiment of the present invention this second sequence of resp. pressure rises and pressure reliefs could be in the area between 2500 psi and 4000 psi.

After the charges 2 of the first device 1 have been detonated, the rupture disc 8 is pumped out and a possible circulation operation has been performed, the drill string can be moved up or down in the well to a different depth, whereby a second ball 17 is dropped down through the drill string and down to the second ball seat 15. It is understood that this second ball seat 15 is sufficiently large to let the first ball 7 of the first ball seat 5 to pass.

With the ball 17 resting in the ball seat 17 the pressure in the drill string can again be pumped up, and a new sequence of resp. pressure rises and pressure reliefs can be gone through, for example in the interval between 2500 psi and 4000 psi, such that the charge 12 is fired. Subsequently the pressure can be run up to for example 4000 psi, whereby the rupture disc 18 bursts, and a new circulation/ventilation sequence can be started.

It is understood that a third set of charges etc. also can be arranged, as the different pressure intervals for the trigger mechanism and the rupture discs must be adapted such that there is enough pump/pressure backup on the rig to perform the row of pressure sequences in a safe way, and at the same time having sufficient margins.

When one in this description is utilizing "lower", "outer" or "below" and also "upper" or "above", it is understood that this is in relation to a string hanging vertically down. However, it is understood that the device also can be utilized in horizontal wells without conflicting the use of terms.

It is understood that the indicated, concrete pressure levels and pressure level intervals are merely examples, as other pressure levels and pressure level intervals just as well can be utilized with the same, advantageous results according to the present invention.

According to another preferred embodiment of the present invention, the device 1 can according to the present invention be utilized to squeeze cement in cases where for instance poor centralization during the original cementing has led to channeling on the outside of the casing. The device 1 is in this instance utilized as described above, but must bring a bride plug (not shown) which is placed below the cementing location and also a packer which seals around the drill string above the cementing location. After the rupture disc 8 has been pumped out, cement is run down into the drill string, through the opening where the rupture disc used to be, into the cavity between the device 1 and the casing, whereby the cement is squeezed out through the recently made holes in the casing wall which the device 1 just stamped out.

To optimize the application of the device 1; 10 especially the effect of the charges 2; 12, it is advantageous that the device 1; 10 is correctly positioned in the bore hole before firing. To get the most even and predictable result, the distance between the charges 2; 12 and the casing wall should be as small as possible. If one guides the drill string down into the well without thereto suitable means for positioning the device 1; 10, the distance between the charges and the casing wall may randomly vary, with the possible result that one either does not achieve the hole in the casing wall that one wishes to, or that one needs to increase the explosive force of the charges by an amount which will risk perforating the surrounding formation in an undesirable way.

According to the present invention the device can comprise an eccentric sub 9; 19 comprising a biased or elastomeric loaded drag block, ref. FIGS. 1, 2 and 3. The drag block sees to that the row of charges 2; 12 is pushed against the casing wall with a suitable force, such that a predictable and desirable perforating of the casing wall is achieved, without causing undesirable damage in the surrounding formation. The eccentric sub (9) is positioned on or close to the diametrically opposite side of the at least one charge (2) on the pipe section (3). The person skilled in the art knows how such eccentric means can be placed to achieve the desirable effect.

As mentioned above, one just wants to stamp holes in the casing wall, not perforate the surrounding formation, when utilizing a puncher tool. For perforating the surrounding formation one utilizes thereto suitable perforating guns. Instead of utilizing the present invention as a puncher tool, one can also adapt it to perform conventional perforating operations. The advantage will be that one saves a substantial amount of time by being able to perform several operations during the same run.

What is claimed is:

1. A device for perforating a downhole casing, the device comprising:

a pipe section, a first charge, and a firing system arranged to fire the first charge;

a first ball seat at a lower end of the pipe section;

a first rupture disc arranged in a first opening in a pipe wall of the pipe section above the first ball seat, wherein when the device is arranged on a drill string, a ball is resting in the first ball seat and pressure on the inside of a drill string and the pipe section exceeds a first predetermined level, the first rupture disc is arranged to burst for providing a fluid communication between the inside and outside of the pipe section through the first opening in the pipe wall of the pipe section;

a second ball seat arranged above the first rupture disc and the first opening; and a second rupture disc arranged in a second opening in the pipe wall of the pipe section above the second ball seat, wherein when a second ball is resting in the second ball seat and pressure on the inside of the drill string and the pipe section exceeds a second predetermined level greater than the first predetermined level, the first rupture disc is arranged to burst for providing a fluid communication between the inside and the outside of the pipe section through the second opening in the pipe wall of the pipe section.

2. The device according to claim 1, wherein the firing system comprises a counter which releases a biased firing pin or a striking plate, or any other trigger mechanism able to being actuated by a predetermined sequence of pressure rises and pressure reliefs.

3. The device according to claim 1, wherein the firing system is actuated by electric signals, acoustic signals, ultrasound signals, telemetry or a timer function.

4. The device according to claim 1, wherein the at least one charge, arranged on the outside of the pipe section, further is arranged on one side of the pipe section, as the device further comprises a mechanical component for pressing the at least one charge against the inside of the downhole casing.

5. The device according to claim 4, wherein the mechanical component for pressing the at least one charge against the inside of the downhole casing comprises an eccentric sub comprising at least one spring-loaded or elastomer-loaded drag-block, the eccentric sub positioned on or close to the diametrically opposite side of the at least one charge on the pipe section.

6. A device for perforating downhole casings, the device comprising:

at least a pipe section, at least a charge, a firing system arranged to fire the at least one charge, wherein the device is arranged on a drill string, and a ball seat at a lower end of the pipe section and also a rupture disc arranged in an opening in a pipe wall of the pipe section above the ball seat, wherein the rupture disc is arranged to burst when the device is arranged on a drill string, a ball is resting in the ball seat and pressure on the inside of a drill string and the pipe section exceeds a predetermined level, for providing a fluid communication between the inside and outside of the pipe section through the opening in the pipe wall of the pipe section wherein the device further comprises a second ball seat arranged above the rupture disc and the opening, a second charge or group of charges, a second firing system and a second rupture disc arranged in a second opening in the pipe wall of the pipe section above the second ball seat, wherein the second rupture disc is arranged to burst when a second ball is resting in the second ball seat and the pressure on the inside of the drill string and the pipe section exceeds a second and greater predetermined level, for providing a fluid communication between the inside and the outside of the pipe section through the second opening in the pipe wall of the pipe section.

7. A method for perforating downhole casings, the method comprising:

arranging a device comprising a pipe section on a drill string, running the device into a bore hole to a desired location in a well, dropping a ball down through the drill string down to the device, where the ball rests in a ball seat, thus blocking fluid communication between the inside and the outside of the device, whereby pressure on the inside of the drill string and the device is pumped up to a first pressure level and a first sequence of pressure rises and pressure reliefs is carried through within a first pressure level interval, whereby a firing system, arranged to react to said first sequence of pressure rises and pressure reliefs, triggers a charge or group of charges, whereby the charge or group of charges punches one or more holes through a surrounding casing wall, running the pressure on the inside of the drill string further up to a second level causing a rupture disc, arranged in an opening in a pipe wall to the pipe section somewhere above the ball seat, to burst and establishing a fluid communication between the inside and outside of the drill string through the opening in the pipe wall of the pipe section, starting a circulation in the well by pumping a fluid down through the drill string and out through the opening which is created when the rupture disc bursts.

8. The method according to claim 7, further comprising:

dropping a second ball down through the drill string down to the device, where the ball rests in a second ball seat located above the rupture disc and the opening, thus again blocking the fluid communication between the inside and the outside of the device, whereby the pressure on the inside of the drill string and the device is pumped up again, but now to a third pressure level, and a second sequence of pressure rises and pressure reliefs is carried out within a second pressure level interval, whereby a different firing system, arranged to respond to said second sequence of pressure rises and pressure reliefs, triggers a second charge or group of charges, whereby the charge or group of charges punches one or several holes through the casing wall, running the pressure on the inside of the drill string further up to a fourth pressure level, causing a second rupture disc arranged in an opening in the pipe wall of the pipe section somewhere above the ball seat to burst and establishing a fluid communication between the inside and the outside of the drill string through the opening in the pipe wall of the pipe section, starting a circulation through the well by pumping a fluid down or up through the drill string and through the opening created when the second rupture disc bursts.

9. The method according to claim 8, wherein the device is firstly moved to a second location in the bore hole before dropping the second ball.

10. The method according to claim 9, wherein the first pressure level interval of the first sequence of pressure rises and pressure reliefs is lower than the second pressure level causing the rupture disc to burst.

11. The method according to claim 10, wherein the second pressure level interval of the second sequence of pressure rises and pressure reliefs is greater than the second pressure level causing the rupture disc to burst.

12. The method according to claim 11, wherein the second pressure level interval of the second sequence of pressure rises and pressure reliefs is lower than the fourth pressure level causing the second rupture disc to burst.

13. The method according to claim 7, wherein thereto suitable measuring and detection components are utilized to detect whether hydrocarbons have been revealed when the charge or group of charges have been fired, whereby the circulation continues until the measuring and detection components indicate that a concentration of hydrocarbons is declining or has fallen below an acceptable level.

14. The method according to claim 13, wherein action is initiated in order to seal leakages on the outside of the surrounding casing wall, as the action comprise one or more from the group comprising: cementing operations, squeezing cement, placing zone isolation seals, placing seals, pumping heavy well fluids and pumping well fluids comprising sealing materials.

* * * * *